US005851964A

United States Patent [19]

Furey et al.

[11] Patent Number: 5,851,964

[45] Date of Patent: Dec. 22, 1998

[54] WEAR REDUCTION USING CYCLIC AMIDE COMPOUNDS

[75] Inventors: Michael J. Furey, Blacksburg, Va.; Czeslaw Kajdas, Plock, Poland

[73] Assignee: Virginia Tech Intellectual Properties, Inc., Blacksburg, Va.

[21] Appl. No.: 792,137

[22] Filed: Jan. 31, 1997

[51] Int. Cl.[6] ..... C10M 133/16

[52] U.S. Cl. ..... 508/243; 508/583; 44/329

[58] Field of Search ..... 508/243, 263, 508/268, 583; 44/329

[56] References Cited

U.S. PATENT DOCUMENTS

| | | | |
|---|---|---|---|
| 3,180,832 | 4/1965 | Furey | 252/56 |
| 3,208,941 | 9/1965 | Owens | 252/45 |
| 3,280,027 | 10/1966 | St. Pierre et al. | 252/45 |
| 3,377,285 | 4/1968 | Randles | 508/243 |
| 3,429,817 | 2/1969 | Furey et al. | 252/56 |
| 3,479,327 | 11/1969 | Merijan et al. | 508/243 |
| 3,929,396 | 12/1975 | Orkin et al. | 508/100 |
| 4,737,304 | 4/1988 | Vo Dinh et al. | 508/243 |
| 5,122,502 | 6/1992 | Bowman et al. | 503/227 |
| 5,304,315 | 4/1994 | Stover | 252/51.5 A |
| 5,407,601 | 4/1995 | Furey et al. | 252/51.5 A |
| 5,637,558 | 6/1997 | Furey et al. | 508/482 |
| 5,651,648 | 7/1997 | Furey et al. | 409/131 |

OTHER PUBLICATIONS

Campbell et al., "Polymer Formation on Sliding Metals in Air Saturated with Organic Vapors", ASLE Transactions, vol. 5, No. 1, pp. 91–104 (1962). month unknown.

Furey, "The Formation of Polymeric Films Directly on Rubbing Surfaces to Reduce Wear", Wear, vol. 26, 1973, pp. 369–392. month unknown.

Furey, "Tribology", Encyclopedia of Materials Science & Engineering, Pergamon Press, Oxford, pp. 5145–5157, 1986. month unknown.

Rao, "Vapor–Phase Lubrication: Application–Oriented Development", Lubrication Engineering, vol. 52, No. 12, Dec. 1996, pp. 845–862.

Lewis, Sr, Hawley's Condensed Chemical Dictionary, 12th Ed., N.Y., "Caprolactam", p. 213. 1993.

Windholz et al, The Merck Index, N.J, "1736 Caprolactam", p. 243, 1983.

*Primary Examiner*—Margaret Medley

*Attorney, Agent, or Firm*—Whitham, Curtis & Whitham

[57] ABSTRACT

Method of reducing wear between rubbing surfaces by contacting a surface of a solid material with a cyclic amide before and/or while it is being rubbed against another surface.

13 Claims, 6 Drawing Sheets

WEAR REDUCTION USING CYCLIC AMIDE COMPOUNDS

BACKGROUND OF THE INVENTION

1. Field of the Invention

The invention is generally related to methods of reducing wear of rubbing surfaces using cyclic amides.

2. Description of the Prior Art

Wear has been defined as the progressive loss of a substance from the operating surface of a body as a result of relative motion at the surface of the body (see, Furey, "Tribology", *Encyclopedia of Materials Science & Engineering,* Pergamon Press, Oxford, pp. 5145–5157, 1986). When elements rub together, whether made of the same or different materials, wear can occur. The rate of wear tends to increase under harsh temperature and pressure conditions which, for example, exist inside ceramic or metal engines, propulsion engines, and the like. In addition to limiting the useful life of the part in which the ceramic or metal is used, wear of ceramics or metal can be costly because the ceramic or metals materials themselves are expensive to produce. Other significant problems associated with wear include, e.g., down time for equipment, reduced safety, and diminished reliability.

Therefore, lubrication, particularly under boundary friction conditions, is extremely important for rubbing materials. Lubrication is a process that reduces friction and/or wear (or other forms of surface damage) between relatively moving surfaces by the application of a solid, liquid, or gaseous substance (i.e., a lubricant). Therefore, the primary function of a lubricant is to reduce friction or wear or both between moving surfaces in contact. However, lubricants can also serve other ancillary functions, such as acting as a hydraulic fluid, coolant, gas seal and carrier for adhesives; they may also protect metal surfaces from corrosion and aid in the removal of debris and deposits. Examples of conventional lubricants are widespread and diverse. They include automotive engine oils, wheel bearing greases, transmission fluids, electrical contact lubricants, rolling oils, cutting fluids, preservative oils, gear oils, jet fuels, instrument oils, turbine oils, textile lubricants, machine oils, jet engine lubricants, air, water, molten glass, liquid metals, oxide films, talcum powder, graphite, molybdenum disulfide, waxes, soaps, polymers, and even the synovial fluid in human joints.

Also, the environments where lubrication needs arise continue to evolve. For instance, in machinery, the classical lubricants and additives more typically have addressed applications involving rubbing parts made of metal, in particular, steel or its alloys. However, more recently there also has been increased interest in using ceramic materials and fiber-reinforced plastics (i.e., composites) in a wide variety of applications which traditionally have utilized metals. Ceramic and composite materials have several advantageous engineering properties. For example, ceramics generally can be used at much higher temperatures than metals, are relatively inert and resist corrosion, and are resistant to abrasive wear owing to their hardness. Additionally, some ceramics are lighter in weight than conventional steel-based materials. Alumina, silicon nitride, partially stabilized zirconia, and silicon carbide, for example, are ceramic materials being used in high temperature wear environments.

Ceramics thus have attracted increased interest for uses along side, in combination with, and/or in lieu of metals, such as in automotive engines, gas turbines, turbomachinery, cutting tools for super alloys, and aerospace bearings, which are driven by a need for industrial materials that can tolerate high temperature, corrosive environments and/or result in better efficiency. However, the surface characteristics of ceramics are very different from those of metals. For these and other reasons, conventional metal lubricants generally have lacked the versatility for successful use in the lubrication of ceramics.

SUMMARY OF THE INVENTION

It is therefore an object of the present invention to provide a method for reducing wear and surface damage to rubbing components.

The foregoing and other objects are achieved by the use of cyclic amide compounds for the boundary lubrication of rubbing solid surfaces. The cyclic amide compounds can be used to reduce wear of rubbing surfaces. The term "rubbing" as used herein refers to solid surfaces in frictional contact with each other. The wear reduction achieved with cyclic amides is applicable to many types of solid surfaces in rubbing contact such as ceramics, metals, composites, plastics, wood, and the like.

The use of cyclic amides to reduce wear combines economic advantages of low cost and wide availability of starting materials with technical advantages such as high solubility in carriers and efficacy at low concentrations.

Cyclic amides useable in the present invention have the following general formula I:

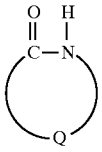

where Q is a group completing the ring. Q can be a substituted or unsubstituted alkylene group, arylene group, or alkarylene group, and the like.

Lactams are a preferred type of cyclic amide for use in the practice of this invention. A "lactam" is a cyclic amide produced from amino acids by the removal of one molecule of water. Lactams contemplated for use in this invention are represented by the following general formula II:

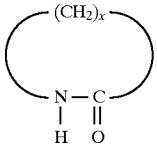

where x is a positive integer greater than or equal to 2, preferably ranging from 2 to 15. The alkylene chain segments $$\text{-}(CH_2)\text{-}$$

of the molecule in formula II are indicated as saturated although it will be understood that any of the hydrogen atoms of one or more of the individual alkylene chain segments can be substituted as long as the added substituent does not interfere with or prevent the wear reducing effect desired of the cyclic amide compound. Similarly, the presence of an unsaturated bond between two carbons of the alkylene chain segment is acceptable as long as the same conditions are met.

The cyclic amide compounds may be used in pure form, or as dissolved, partly dissolved or dispersed in a carrier medium. To reduce material costs, the cyclic amide can be dispersed or dissolved in a carrier medium. A carrier fluid is used as a medium for the cyclic amides. The term "fluid" means any material or substance that changes shape or direction uniformly in response to an external force imposed upon it. The term can apply not only to liquids, but also to gases and to finely divided solids. For example, the region of rubbing contact (i.e., the interface) between a first solid part and a second solid part can be flooded with, immersed in, or exposed to the lubricating carrier medium (e.g., liquid, gas, semi-solid) containing the cyclic amides. Experiments described herein have been conducted which show that fluid compositions containing even very low concentrations of cyclic amides significantly reduce the amount of wear and surface damage otherwise suffered by ceramics and metals in rubbing or wearing contact.

Specific applications of the present invention are widespread and diverse.

The cyclic amides can be used to reduce wear between mechanical parts in contact with each other, such as between gears, between a valve lifter and a cam of an automotive engine, and between a piston and cylinder in a motor. The cyclic amides also can be used in lubricating and reducing wear of bearings (e.g., steel bearings, ceramic bearings). The cyclic amides also can be used in machining and cutting operations to reduce wear of a machining/cutting tool (ceramic or metal) used in a machining operation such as lathing, broaching, tapping, threading, gear shaping, reaming, drilling, milling, hobbing, grinding, turning operations, and the like.

The cyclic amides also can be used as fuel lubricity and anti-wear additives in combustion fuels, such as hydrocarbon fuels, including gasolines, aviation turbo fuel, jet fuel, rocket fuel (e.g., kerosene), and diesel fuels. The cyclic amides can be added in effective amounts to the engine fuel itself such that a sufficient amount of unburned cyclic amides remains present in the cylinder during the engine cycle to lubricate and reduce wear between the piston and cylinder. For example, methods of the present invention can be applied to lubrication of gasoline engines, such as two-stroke engines, where the cyclic amide compounds of the invention can be used as a fuel additive to lubricate and reduce wear of rubbing and contacting engine parts during operation. The cyclic amides can be added directly to the engine gasoline, or to gasoline via a separate carrier fluid such as a lubricating mineral or synthetic oil to be added to the gasoline, to reduce engine wear. The lubricating compositions of the invention can be added to diesel fuel to control wear of diesel fuel injector pumps where metal-to-metal contact occurs, while at the same time reducing exhaust emissions.

The cyclic amide compounds used in the present invention may be used as the sole additive in the fuel medium or in conjunction with other performance-enhancing additives added to the fuel, such as detergents, corrosion-inhibitors, alcohols (e.g., ethanol) or ethers (e.g., methyl-tertiarybutyl ether).

The cyclic amides used in the invention also can be used as an anti-wear agents in automotive engine oil lubrication applications. For example, the cyclic amides can be used in conjunction with or in place of a conventional engine oil antiwear additives (e.g., zinc dialkyl dithiophosphate or "ZDDP") in liquid lubricating oils. Methods of the invention can be applied to the lubrication of four-stroke engines, for instance, where the cyclic amides are introduced into the engine as an additive to the lubricating oil. Also, the cyclic amides could be used in short duration "dry" testing of four-stroke engines in which the cyclic amides are introduced via the oil inlet of the engine, such as by vapor phase injection, without any liquid lubricating oil being added or needed in the engine.

Other types of combustion engines where cyclic amides are contemplated to be useful for wear reduction in rubbing engine parts include, for example, adiabatic or low heat-rejection engines in which ceramic components are employed, advanced propulsion systems using turbomachinery, and any engine or power-producing device in which hydrocarbon or fossil fuels are used as the source of energy.

The compositions of this invention, where used as an anti-wear additive for engine oils or fuels, offer an important advantage in that the cyclic amide compounds used are devoid of metals, phosphorus, or sulfur, which could lead to solid residues, soots, and deposits in a combustion chamber of an engine (in the case of metals and phosphorus), or interfere with the action of emission catalyst systems. The absence of ash or soot deposit formation, for example, by use of the compositions of the invention is advantageous as ash and soots also might interfere with the antiwear action of any another supplemental antiwear additives being used such as ZDDP. The cyclic amides, when combusted in a high temperature environment, such as in a combustion engine, form ashless, gaseous combustion products (e.g., $H_2O$, $CO_2$), and, as such, pose no threat to foul the catalyst in a catalytic converter and pose reduced environmental concerns.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
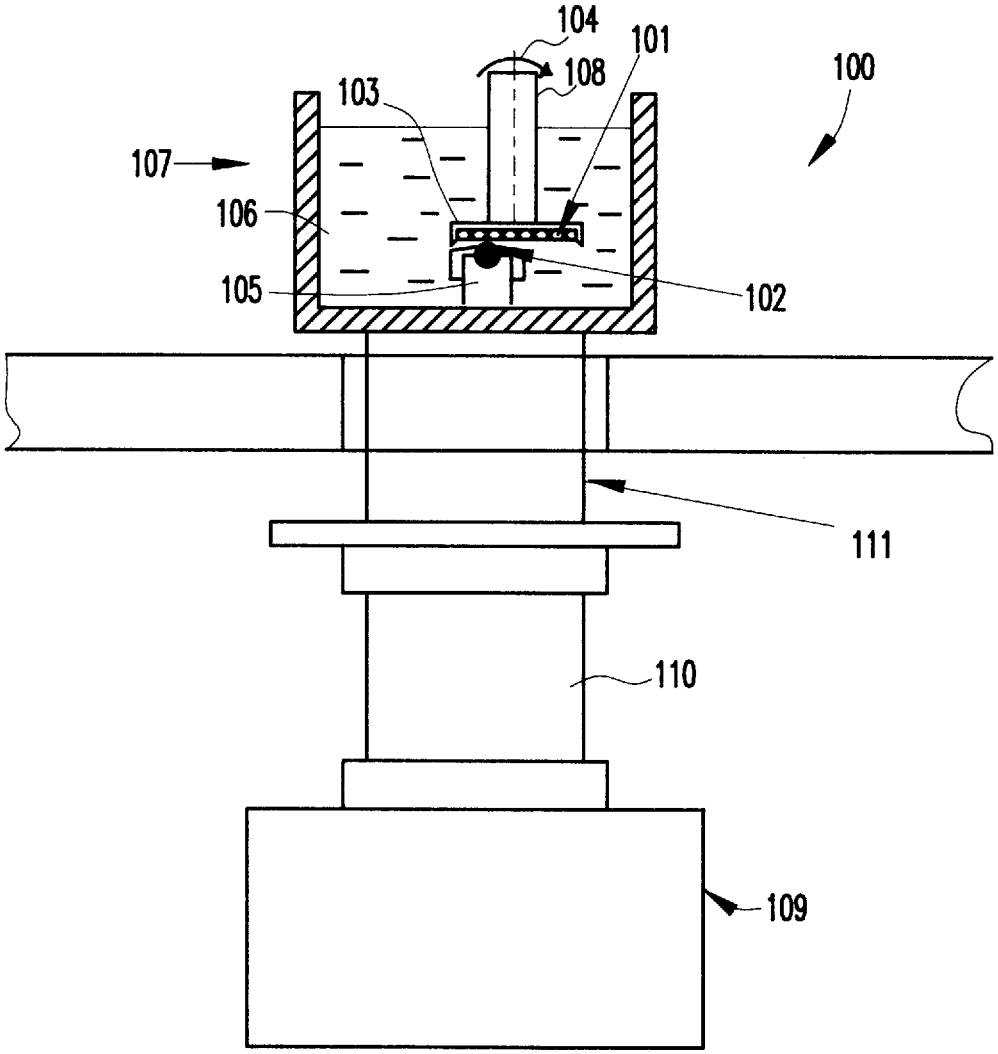
FIG. 1 is a diagram showing an apparatus used to conduct liquid phase high contact stress pin-on-disk experiments.

The present invention concerns use of cyclic amide compounds to significantly reduce the amount of wear and surface damage otherwise suffered by a rubbed surface or surfaces. The reduction in wear is achieved even at high stress conditions of high load and high speed rubbing conditions between surfaces of materials.

Cyclic amides useable in the present invention have the following general formula I:

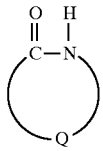

where Q is a group completing the ring. Q can be a substituted or unsubstituted alkylene group, arylene group, or alkarylene group, and the like.

Lactams are a preferred type of cyclic amide for use in the practice of this invention. A "lactam" is a cyclic amide produced from amino acids by the removal of one molecule of water. Lactams contemplated for use in this invention are represented by the following general formula II:

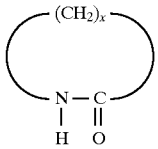

where x is a positive integer greater than or equal to 2, preferably ranging from 2 to 15.

Non-limiting examples of lactams within the scope of formula II useful as antiwear agents in practicing this invention are listed below in Table A:

TABLE A

| Lactam Name | x value |
|---|---|
| 2-azetidinone | 2 |
| ϵ-caprolactam (2-oxohexamethyleneimine) | 5 |
| 2-azacyclooctanone | 6 |
| 2-azacyclononanone | 7 |
| 2-azacyclotridecanone (laurolactam) | 11 |

The alkylene chain segments $$\text{-}(CH_2)\text{-}$$

of the above formula II for lactam are indicated as saturated; although it will be understood that any of the hydrogen atoms of one or more of the alkylene chain segments can be substituted as long as the added substituent does not interfere with or prevent the wear reducing effect desired of the cyclic amide compound. In general, the alicyclic hydrocarbon chain segments $$\text{-}(CH_2)\text{-}_x$$

in formula II will undergo the same reactions as their open-chain analogs, viz., cycloalkanes undergo chiefly free-radical substitution, such as substitution of a hydrogen atom with a halide atom. For example, a halide atom could be substituted for a hydrogen atom in the $$\text{-}(CH_2)\text{-}$$

segment by reaction of the cyclic amide with $Cl_2$ (light catalyzed) or with $Br_2$ (with heating at about 300° C.). Addition reactions are not contemplated as they would open the alicyclic ring segment of the molecule. The presence of an unsaturated bond between two or more carbons of the alkylene chain segments in the Q group (i.e., $$\text{-}(H_2C)\text{=}(CH_2\text{-})$$

is acceptable as long as the added unsaturated bond(s) does not interfere with or prevent the wear reducing effect desired of the cyclic amide compound.

Due to the substantial demand for lactams as raw materials in the production of a number of polyamides which are the polymers from which nylon fibers are made, a number of methods have been developed in the chemical industry for making these materials. Caprolactam is the most important raw material in the production of nylon 6. A large percentage of caprolactam is produced by the so-called cyclohexanone process where cyclohexanone is reacted with hydroxylamine to produce a cyclohexanone oxime intermediate followed by a Beckman rearrangement reaction to give caprolactam. Caprolactam also can be prepared by photonitrosation of cyclohexane or by nitrosation of cyclohexanecarboxylic acid in the presence of sulfuric acid, which technique is sometimes referred to as the "Toray Photonitrosation Process". Another lactam, ω-capric lactam, can be produced in a multi-stage process from decalin. The butadiene trimer cyclododecatriene can be converted to lactam $C_{12}$ with a first step involving epoxidation with paracetic acid or acetaldehyde monoperacetate to give cyclododecadiene monoepoxide. These examples of techniques to make lactams are not exhaustive, and one of ordinary skill will appreciate other known methods for making these compounds. Therefore, it is not believed necessary to elaborate further on the various well-known techniques for making lactams.

The cyclic amide compounds, when used to reduce wear in the practice of this invention, may be used in undiluted pure form, or as dissolved, partly dissolved or dispersed in a carrier medium. To reduce material costs, the cyclic amide can be dispersed or dissolved in a carrier medium. Significant reductions in wear have been achieved even where the cyclic amide is used at very low concentrations in a medium.

The liquid carrier can be organic or aqueous. The liquid carrier can be a hydrocarbon material such as mineral oils, vegetable oils, synthetic oils, liquid petroleum distillates and refined products therefrom, long chain $C_{10}$ to $C_{20}$ saturated alkanes, and polyalkylene glycols. Non-limiting examples are provided below for these classes of hydrocarbons.

Mineral oils can be petroleum-based types such as aliphatic or wax-base (Pennsylvania), aromatic or asphalt-base (California) or mixed-base (Midcontinent U.S.A.). The mineral oils also can be petroleum-derivatives such as engine oil lubricants, machine oil lubricants, and cutting oil lubricants. The vegetable oils can be linseed oil, tung oil, soybean oil, castor oil, and palm oil. The synthetic oils can be diesters, sebacates, ethoxylates, and the like. The liquid petroleum distillates and refined products therefrom can be gasoline, kerosene, fuel oils, gas oil and lubricating oils. The long chain saturated alkanes can be n-hexadecane ($C_{16}H_{34}$; cetane). The polyalkylene glycols can be polyethylene glycols.

The cyclic amide generally is contained in a liquid carrier in an amount, by weight, of about 0.01% or more, preferably ranging from 0.01 to 10.0%, and more preferably ranging from 0.1 to 5.0%, by weight. The lower limit on the concentration of the cyclic amides in the carrier liquid generally will be that amount on the contacting region of the rubbing surfaces, whether ceramic, metal and/or composite materials, and so forth, that is adequate to impart wear and friction reduction effects, which can be empirically assessed such as by tests described herein.

The gas form of carrier fluid can be air, nitrogen, gaseous combustion fuels, and hydrocarbon combustion product gases, and the like. Vapors are included within the scope of the term gas. For instance, vapors of liquid hydrocarbon fuels (e.g., gasoline, diesel fuel) can be used as a carrier for the cyclic amides. The lubricating gaseous compositions can contain the cyclic amides in relatively dilute amounts including a total amount of 0.001 to 0.02 g/l of the gaseous composition (or approximately $0.3\times10^{-5}$ to $8.0\times10^{-5}$ moles/l of gas).

Higher concentrations of the cyclic amide compound may also be useful in the gaseous phase, with the upper concentration limits being those which would produce saturated vapor at a given pressure and temperature. The lower limit on the concentration of the cyclic amides in the carrier gas generally will be that amount on the contacting region of the rubbing surfaces, whether ceramic, metal and/or composite materials, that is adequate to impart wear and friction reduction effects, which can be empirically assessed such as by tests described herein.

The cyclic amide compounds may be introduced into the carrier gas in a number of different ways, for example:

(a) heating the cyclic amide compound externally to form a vapor and then introducing the vapor into a flowing stream of inert gas (e.g., nitrogen);

(b) injecting the cyclic amide compound in liquid form into a stream of carrier gas so that vaporization thereof will occur. For example, the lactam compound can be injected in liquid form into a stream of air to atomize the cyclic amide compound and form a vapor or mist. This vapor or mist can be delivered to: (i) diesel engine compression chambers; (ii) gasoline engine compression chamber with a fuel injection system; (iii) any type of engine designed to operate at high temperatures (e.g., engines with metal and/or metal alloy parts, and also adiabatic or low heat-rejection engines using ceramic components);

(c) dissolving the cyclic amide compound in a hydrocarbon carrier liquid and then injecting the resulting liquid composition in liquid form into a stream of carrier gas so that vaporization thereof will occur;

(d) vaporizing carrier liquids (e.g. fuels) containing dissolved cyclic amides to generate a vapor containing cyclic amides, which vapor is conducted to a rubbing contact site; and (e) any technique of adjusting pressure and temperature of the cyclic amide compound and carrier gas which results in the cyclic amide compound being present as a vapor in the mixture. These modes of gas phase application of the cyclic amides are applicable to any of ceramic, composite, and metal surfaces, especially those operated at high temperatures.

The cyclic amide delivery temperatures covered by this invention range from room (e.g., about 20° C.) to 500° C., with many applications being below 360° C. The temperature of the carrier gas and cyclic amide can be regulated, for example, by passing the carrier gas through a heated flask or vessel containing liquid cyclic amide that is being volatized by application of heat under thermostatic control; once the carrier gas picks up volatized cyclic amide vapor in the flask it can be transmitted by conduits/tubes to a tube opening positioned proximate the contacting (rubbing) region of the surface or surfaces in contact. The cyclic amide can be delivered to the surface areas of one or both of the solid bodies where rubbing will occur or is occurring between the two (or more) solid bodies. The actual compound vapor delivery temperatures to be used in practice will depend on the desired final vapor concentrations as well as the vapor pressure-temperature properties of the selected anti-wear/anti-friction compound. For example, a lower molecular weight, lower boiling point compound can be introduced as a vapor at a lower temperature than a higher molecular weight compound. Measurements of vapor flow, weight change of the vapor source, or vapor concentration can be made in order to regulate the desired vapor concentration. It has generally been found that delivering the vapor at a higher temperature is preferred.

It should be appreciated that the cyclic amide can be dispersed or dissolved in a carrier medium primarily for reduction of material costs. However, it is also possible to use the cyclic amide compounds without dissolving or dispersing the cyclic amides in a carrier fluid. For instance, cyclic amide fluids per se can be heated to increase the vapor pressure and provide a vapor of the compound. Alternatively, the cyclic amide compounds can be injected in liquid form directly into an engine compression chamber during the compression cycle whereby vaporization of the compound occurs.

The cyclic amides also can be dispersed in a semi-solid carrier medium, such as hydrocarbon grease, silicone grease, or wax. The cyclic amides can generally be contained in the semi-solid carrier in higher concentrations, if desired, because of diminished solubility concerns. The cyclic amide generally is contained in a semi-solid medium in an amount of about 5% or more, by weight, preferably 2 to 10%, by weight.

The cyclic amide compounds also can be present in a carrier in conjunction with other additives commonly used in the particular environment at hand. For example, where the cyclic amide compounds are used as a lubricity additive for an engine fuel, the engine fuel can also contain other additives used to improve engine performance (e.g., dispersants, anti-oxidants, corrosion-inhibitors). The primary function of the carrier medium, if used, is to facilitate transport of the cyclic amide compounds onto the surface of the ceramic, metal, or other type of element in rubbing contact. Any carrier fluid capable of such cyclic amide dissolution or dispersion, and transport, is deemed to be within the scope of the invention as long as it does not react chemically with the cyclic amide in the bulk fluid. That is, the carrier fluid, whether liquid, gas, or semi-solid, cannot react with and is thus inert, in a limited sense, relative to the cyclic amide compounds and it plays no part in the cyclic amides' function other than to assist in their delivery to designated contacting regions on rubbing surfaces needing lubrication, thus "carrying" the additives in the liquid, gas or semi-solid phase.

It is also to be understood that the carrier medium liquids or gases will be selected on the basis of providing proper volatility, boiling point, chemical reactivity, and so forth, to fulfill the functions needed by the cyclic amides and also any functions separately required of the carrier liquid itself (e.g., engine oils, engine fuels).

The antiwear compounds and dispersions or dissolved solutions of same can be pre-coated on surfaces prior to rubbing and/or introduced to the rubbing interface during contact.

The substrates that can be lubricated and experience wear reduction by the inventive method are not particularly limited, and include, for example, ceramics, metals, composites, plastics, and wood, or combinations thereof. The rubbing surfaces involve two (or more) contacting surfaces of solid materials. The contacting surfaces can be in relative motion to each other. For example, confronting surfaces of two separate solid bodies can both be moving in sliding contact over one another, or alternatively, one surface can be stationary while another surface of another body is set in motion to slide in contact over the surface of the stationary body. Also, the inventive method can be used to lubricate a plurality of metal surfaces in rubbing contact, a plurality of ceramic surfaces in rubbing contact, or both a metal surface and a ceramic surface in rubbing contact. Metals that can be lubricated by the invention, include, for example, steel, alloy steels, alloy cast iron, aluminum alloys, titanium alloys and other advanced high strength, high temperature metallic alloys. Ceramic materials that can be lubricated by the present invention include, for example, alumina, zirconia, silicon nitride, silicon carbide, boron nitride, aluminum nitride, boron carbide, beryllia, and combinations thereof. Polymer matrix composites (e.g., carbon fiber/epoxy, glass fiber/nylon, carbon/polyether ether ketone, and high temperature polymeric composites) also can serve as substrates to be lubricated by the invention.

The following non-limiting examples will further illustrate the present invention. All parts, ratios, concentrations, and percentages are based upon weight unless otherwise specified.

EXAMPLES

Experimental Procedure:

In the examples described below, pin-on-disk tests were conducted using an apparatus according to FIG. 1 to investigate the anti-wear effects of the present invention in ceramic-on-ceramic and steel-on-steel rubbing systems run under high contact stress conditions.

Referring more particularly to FIG. 1, there is shown a diagram of a pin-on-disk test apparatus arrangement represented generally as 100. The apparatus of FIG. 1 is based on the use of a milling machine capable of tests at high loads and speeds. The test apparatus 100 includes a disk holder 103 attached to a rotating chuck 108 of a milling machine capable of high speed rotation about an axis indicated by arrow 104. The speed of rotation of the chuck 112 and disc holder 103 was accurately controlled by speed settings of the milling machine. The test disk 101 is releasably supported by disk holder 103 by means of a TEFLON backing piece to allow both sides of a disk to be used for tests. The back of the TEFLON disk holder was supported by a mill chuck piece. The ball holder 105 and lubricant cup holder 107 were supported by a linear motion ball-spline shaft 111 and loaded by a pneumatic pancake cylinder 109. A test ball 102 is positioned on the end of a ball holder 105 and contacts the disk 101 during the experiments. The ball 102 is firmly secured to the holder 105 during testing by using an epoxy resin; hence, it does not rotate during the test run, rather it slides against the rotating disk 101. A lubricant 106 is held in lubricant cup 107 in a volume which covers the top of ball 102. How well the lubricant 104 protects the disk 101 and the ball 102 from wear was the primary focus of this experimentation.

Milling machine gear adjustments allowed control of rotational speed and a x-y-z positioning table (not shown) on the milling machine allow precise placement of the ball 102 relative to the radius of the disk 101. The normal load is controlled by pressure adjustments to the pneumatic cylinder 109 to obtain a desired strain indicator output. Strain gages attached to a thin wall aluminum cylinder act as a force transducer 110 to monitor the normal (z direction) force in the pin-on-disk system. Tests were carried out with ceramic-on-ceramic as well as steel-on-steel contact systems using this apparatus.

Several lubricant compositions 206 were prepared to determine their ability to reduce the amount of wear on the test disk 201 and test ball 202. The lubricant compositions 206 consisted of a hexadecane carrier fluid together with one of the tested cyclic amides additives dissolved or dispersed therein. The tested cyclic amides did not chemically react with the hexadecane carrier fluid. The lubricant compositions 206 were prepared at the various concentration levels of the tested cyclic amide in hexadecane, as indicated herein. Hexadecane is a pure, well-defined carrier fluid of known chemical structure and was selected for its relatively inert characteristics for test purposes. The function of the carrier fluid was merely to deliver the cyclic amide compounds to the region of interfacial contact between the ceramic or steel ball and disk elements.

As to the procedure used in the wear experiments, the test balls were spherical and had a 6.4 mm (¼ in.) diameter. The test disks were flat circular shapes having diameters of 25 mm (1.0 in.) and thicknesses of 3.2 mm. These dimensions applied to all test balls and disks, whether ceramic or steel material types.

For the ceramic-on-ceramic systems, alumina balls were obtained from Sapphire Engineering, Inc., which were 99.5% pure Grade 25 balls. Alumina disks were obtained from LSP Industrial Ceramics and the disks were made by cutting 99.5% pure isostatically pressed alumina rod. The disks were ground to an average surface roughness of 0.5 to 0.65 $\mu$m (CLA). The alumina disks were obtained from the above-identified source in two separate batches, identified herein as Batch A and Batch B.

For the steel-on-steel systems, AISI 52100 steel balls (Grade 10) and polished 1045 steel disks were used.

The balls and disks used in the examples were ultrasonically cleaned in baths of hexane, methanol, and de-ionized water for 20 minutes per liquid, and then dried in a vacuum oven at 150° C. for two hours and stored, when necessary, in a dessicator until needed for testing.

At the beginning of each test, the strain indicator was turned on to allow stabilization of the output. The radius of contact of the ball 102 on the disk 101 was set to 8 mm from the disk center by using the x positioning table on the milling machine according to pre-calibrated marks on the x positioning. The rotational speed was set using head-spindle rotational RPM shift levers (not shown), and then the air supply to the pneumatic cylinder was connected and pressurized. The power to the milling machine, the air cylinder control power supply and a digital pressure indicator were all turned on.

After loading a clean disk in the TEFLON backing piece, the disk 101 and the stainless steel housing of disk holder 103 were screwed on a steel backing piece in the mill chuck. A clean ball 102 was then placed into holder 105 and the lubricant cup holder 107 threaded into ball-spline shaft 111. The lubricant composition 106 to be tested was placed in the volume created by the lubricant cup holder 107 at a liquid temperature of 20° C. before the ball 102 was brought into contact with the disk 101. The volume of lubricant composition was adequate to cover the top of the ball 102 during the wear test.

Before the test would be started, the strain indicator was balanced to produce a zero reading. After setting the vertical position of the milling table, the milling machine rotation was started and the air pressure increased to the proper load. The disk holder 103 had a rotational speed provide via chuck 108 to adequate to provide a sliding velocity of 0.25 m/s or 0.75 m/s, as indicated. During each test run, the disk was rotated at a constant speed for a time period sufficient to provide a total sliding distance of the ball 102 relative to the disk 101 of 250 m. The ambient temperature during the tests was 19° to 22° C. and the relative humidity 35% to 45%.

In the experiments, the applied load was either 40 Newtons (N) of force resulting in a mean Hertzian pressure of 1.3 GPa, or 80N of force, as indicated, to create a relatively high load environment. These load values exceed the severe environment of a highly loaded cam nose in a typical automotive engine valve train, which has a calculated mean Hertzian pressure of about 1 GPa.

The wear on the disk 101 and the wear on the ball 102 were determined by a photomacroscope and profilometric techniques and recorded in volume units. The two volumes were added together to determine a total volume worn away. The total volume worn away from the test disk and test ball when a test lubricant composition containing cyclic amides was used was then compared to the total volume worn away from a disk and a ball when hexadecane, without a cyclic amides additive, was used as the lubricant.

As mentioned, a photomacroscope and stylus profilometer were used to make the necessary measurements on the disk 101 and ball 102. The method of determining the amount of wear on ball 102 and disk 101 is straightforward. The fixed ball 102 is worn down to leave a single flattened circular area or scar on the face of the spherical ball 102 at the location where the sliding contact is made with the rotating disk 101. A continuous, circular wear channel is formed in disk 101 at the location where the ball 102 contacts the rotating disk 101. A Leitz-Wild Photomacroscope was used to measure the major and minor diameters of the ball wear scar, and an average wear scar diameter was determined. Using the average diameter of the spherical cap segment removed from the ball 102 during the test and the radius of the spherical cap shaped portion that was worn away at the scar (viz., the difference of the original overall ball diameter and the reduced overall ball diameter at the scar), the volumetric wear for the ball 102 is easily calculated using well-known geometric relationships. By determining the area of a cross-section of the channel worn into disk 101 and determining the radius of the channel, the volume of the channel in the disk 101 was also calculated by well known techniques.

A disk 101, after the test run, has a channel is worn into the disk 101 at the point the ball 102 that contacts the disk 101 while it is rotated. By determining the area of a cross-section of the channel and determining the radius of the channel, the volume of the channel is calculated by well known techniques. More specifically, a Taylor-Hobson Talysurf profilometer was used to take the profilometer traces of the disk wear scar at four equidistant locations on the disk, 90° apart. From these traces, an average cross-sectional area of the wear scar on the disk was the difference between the trace and the original zero plane surface of the disk. The volume of disk wear was calculated from the cross-sectional area of the worn track multiplied by the track circumference.

Examples 1, 2 And A:

ϵ-Caprolactam, obtained from Eastman Kodak Co., Rochester, N.Y., (Cat. No. 119 1741, MW 113.16, m.p. 70° C.), was dispersed in hexadecane and tested for wear reduction in a ceramic-on-ceramic system.

Wear was then measured for the ceramic disks and balls according to the Experimental Procedure, using disks from Batch A. For Example 1, the lubricant compositions tested contained one percent by weight (1.0 wt %) of ϵ-caprolactam in a hexadecane carrier fluid (Example 1). In Comparison Example A, hexadecane alone (0% caprolactam) was used as a control composition. The hexadecane was obtained from Aldrich Chemical, Milwaukee, Wis. (Cat. No. H670-3, 99% pure, MW 226.45, f.p. 135° C.). The 1 wt % caprolactam was partly soluble in the hexadecane such that a portion was dissolved, while the remainder was undissolved and dispersed. To make sure that no solid impurities were present in the caprolactam solution which might alter the results, another lubricating composition was tested after the composition had been filtered. The filtered 1% caprolactam composition was designated Example 2.

Wear reduction was measured by comparing total (ball and disk) loss in ball and disk material (in $mm^3$) against the results observed for the hexadecane fluid alone. The results are reported in Table 1.

TABLE 1

| Example | Additive in hexadecane | Total Wear Volume[2] ($mm^3$) | Ave. Wear Reduction (%) |
|---|---|---|---|
| A | none[1] | 27.1 | — |
| 1 | 1.0 wt % ϵ-caprolactam | 0.09 | 99.8 |
| 2 | filtered caprolactam[3] | 0.10 | 99.6 |

[1]: average of 8 test runs
[2]: total wear = ball wear plus disk wear @ 0.25 m/s sliding velocity, 250 m total sliding distance and 40 N load.
[3]: filtered 1 wt. % ϵ-caprolactam; the actual concentration of dissolved caprolactam remaining in the filtered solution was not determined but was estimated to be significantly less than 1 wt. %.

Figure 2:
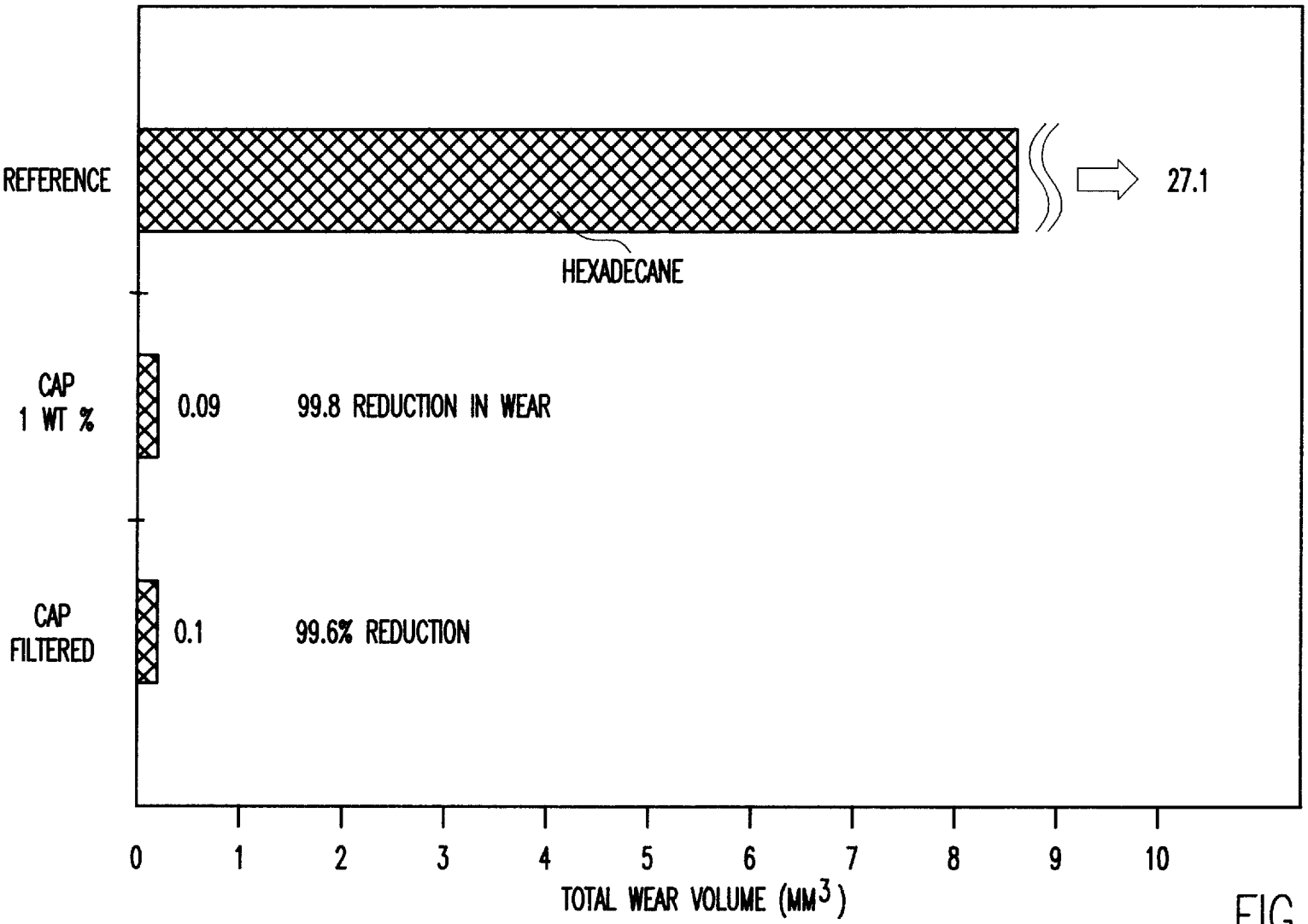
FIG. 2 is a graph showing wear reduction achieved with caprolactam as an antiwear agent for an alumina-on-alumina rubbing system.

The results summarized in Table 1 are graphically shown in FIG. 2. The lubricating compositions containing 1 wt. % caprolactam composition demonstrated significantly reduced wear as compared to the hexadecane control containing no cyclic amides. The 99.8% (unfiltered composition) and 99.6 (filtered composition) reductions in wear achieved with the lubricating compositions containing only 1 wt. % lactam additive were quite remarkable.

Examples 3–5 And B:

Lubricating compositions containing different concentrations of unfiltered ϵ-caprolactam, viz., 1.0 wt. % (Example 3), 0.1 wt. % (Example 4), and 0.02 wt. % (Example 5), were dissolved in a hexadecane carrier. These examples were tested for wear reduction in a ceramic-on-ceramic ball and disk system against a control composition containing only hexadecane (Comparison Example B) in the same manner as used in Example 1 except that ceramic disks from Batch B were used.

The caprolactam was partly dissolved and partly dispersed at the 1.0 wt. % concentration, but was completely soluble at the 0.1 and 0.02 wt. % concentrations in the lubricating compositions.

Figure 3:
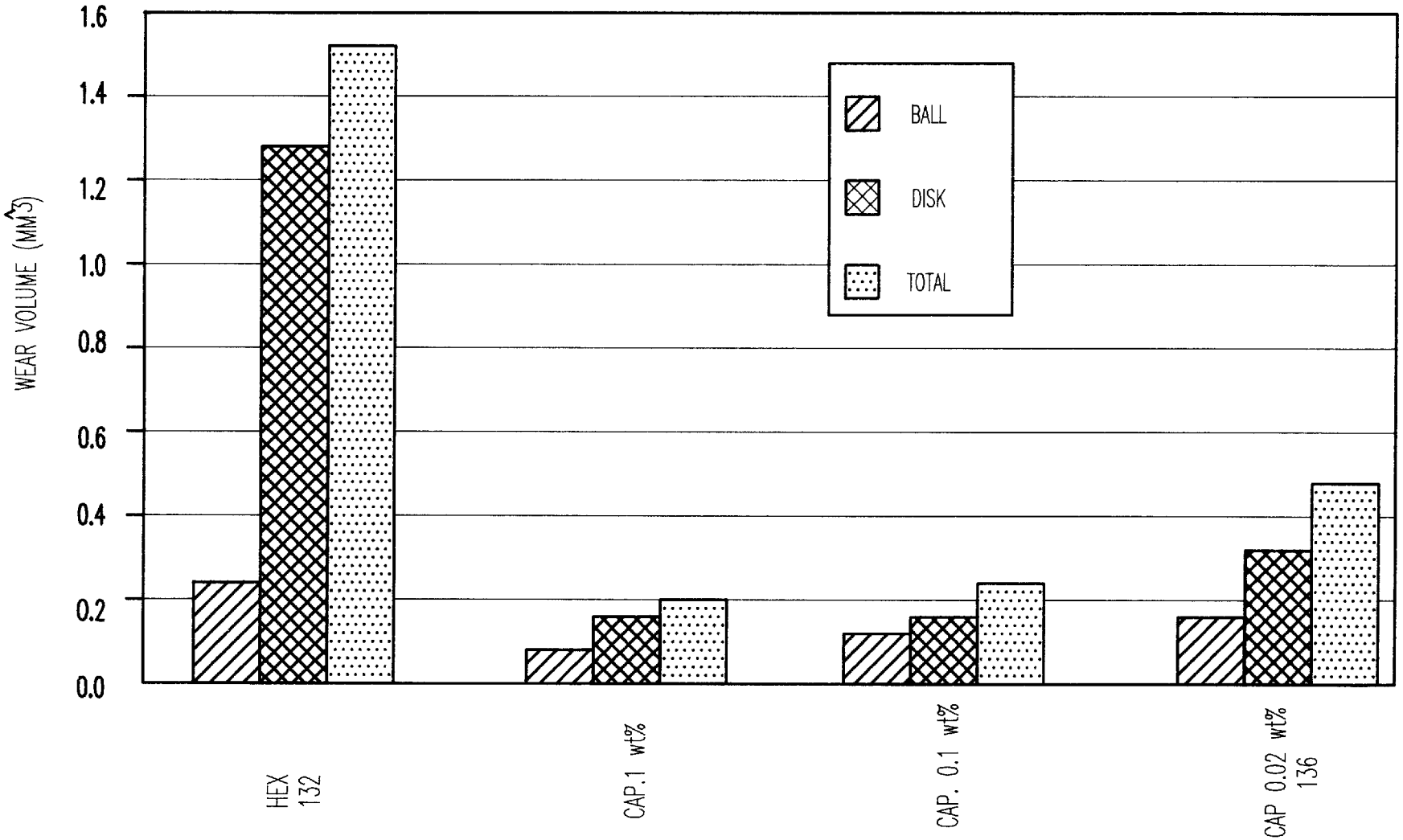
FIG. 3 is a graph showing wear reduction achieved with caprolactam as an antiwear agent for an alumina-on-alumina rubbing system at different concentration levels of caprolactam.
Figure 4A:
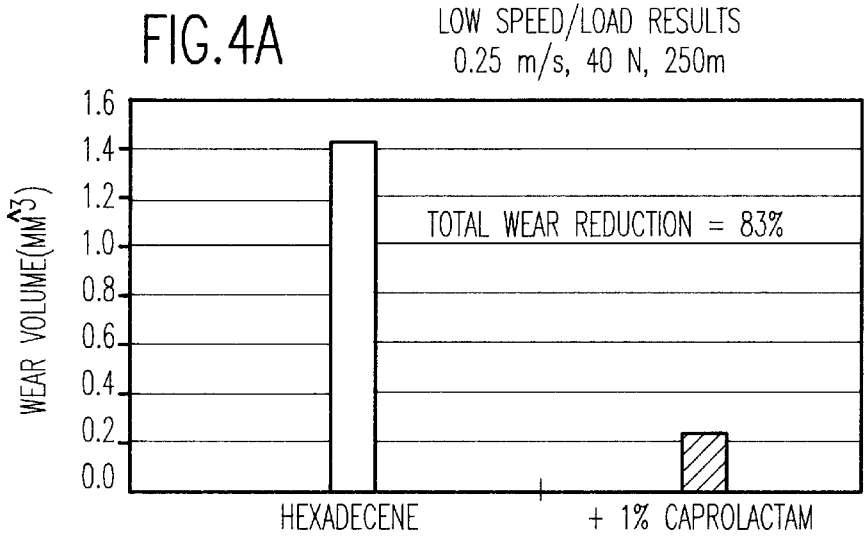
FIGS. 4A, 4B, 4C, and 4D are graphs showing wear reduction achieved with caprolactam as an antiwear agent for an alumina-on-alumina rubbing system at different speed and load combinations for a given concentration level of caprolactam.
Figure 4B:
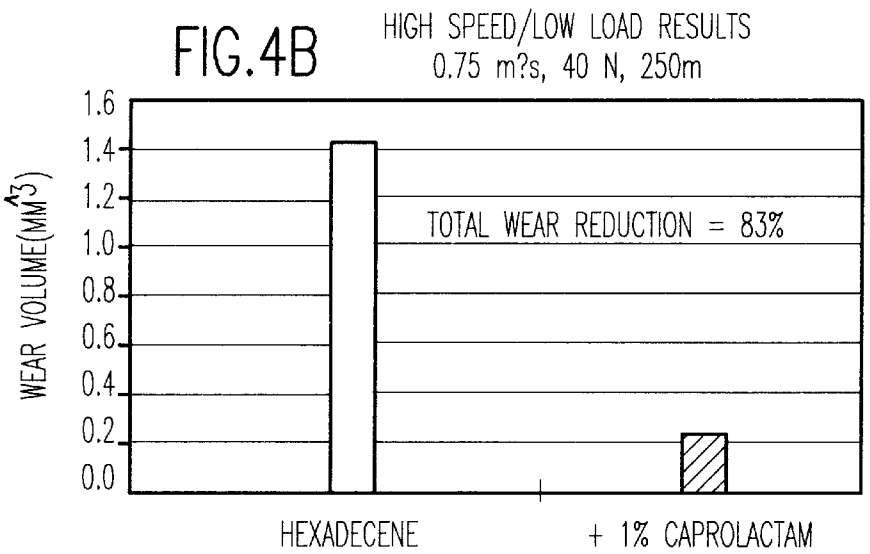
Figure 4C:
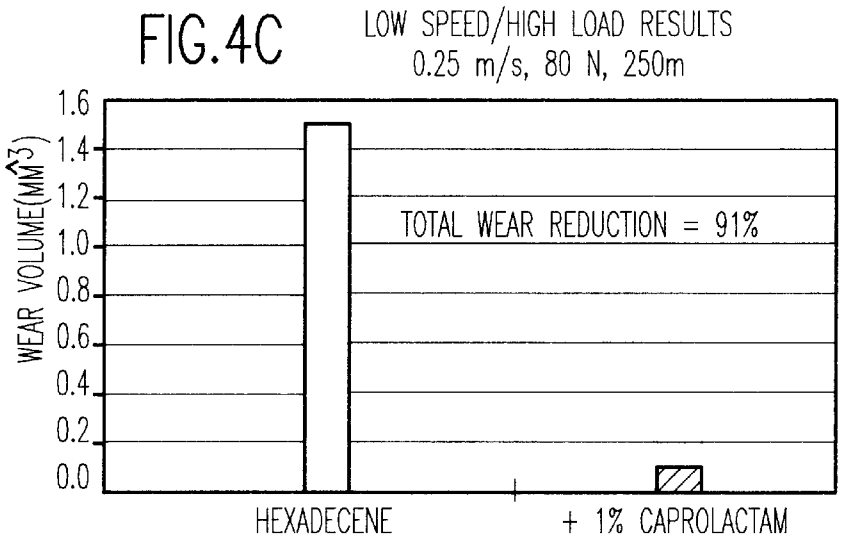
Figure 4D:
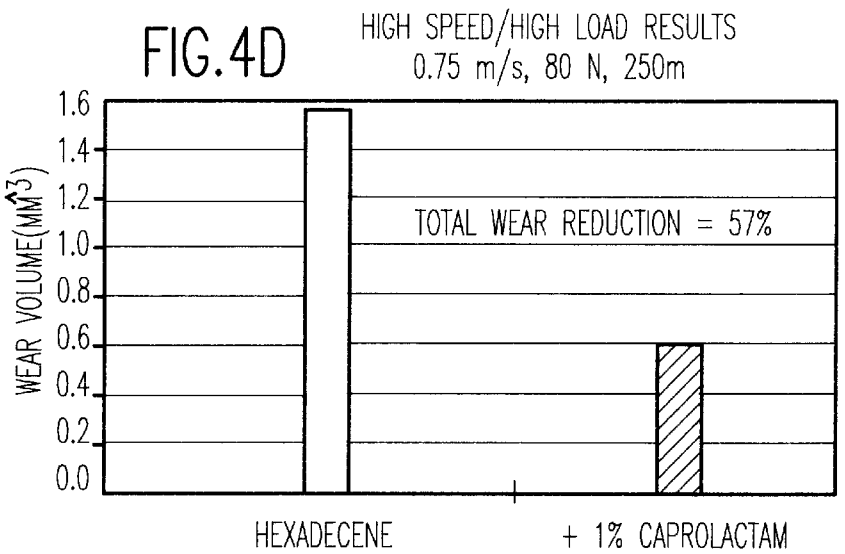

The results are summarized in Table 2 and graphically shown in FIG. 3.

TABLE 2

| Example | Additive in hexadecane | Wear ($mm^3$) Ball | Disk | total[2] | % reduction in wear |
|---|---|---|---|---|---|
| B | none[1] | 0.208 | 1.045 | 1.253 | — |
| 3 | 1.0 wt % ϵ-caprolactam | 0.066 | 0.135 | 0.201 | 84% |
| 4 | 0.1 wt. % ϵ-caprolactam | 0.095 | 0.142 | 0.237 | 81% |
| 5 | 0.02 wt. % ϵ-caprolactam | 0.165 | 0.296 | 0.461 | 63% |

[1]: Wear results based on average of 16 test runs
[2]: Total wear = ball wear + disk wear @ 0.25 m/s sliding velocity, 250 m total sliding distance and 40 N load.

The results summarized in Table 2 and graphically shown in FIG. 3 show that the lubricating compositions containing caprolactam maintained outstanding wear reduction even at lower concentrations of 0.1 wt. % and 0.02 wt. %; the latter being 1/50th the 1 wt. % concentration.

Examples 6–9 And C–F:

Lubricating compositions, designated Examples 6–9, containing caprolactam in 1.0 wt. % concentration in hexadecane carrier, were tested against control compositions C, D, E, and F, respectively, containing hexadecane alone in a ceramic-on-ceramic ball and disk system at various combinations of applied load (i.e., either 40N or 80N) and chuck speed (0.25 ml/s or 0.75 ml/s) again using the same wear testing procedure as used in Example 1 except with use of test disks from Batch B. Wear results for control compositions C, D, E, and F were based on the average of 16 test runs.

The test results are summarized in Table 3 below.

TABLE 3

| Example | Load (N) | Sliding Velocity[1] (m/s) | Total Wear[2] ($mm^3$) | Wear Reduction % |
|---|---|---|---|---|
| C | 40 | 0.25 | 1.446 | — |
| 6 | 40 | 0.25 | 0.245 | 83% |
| D | 40 | 0.75 | 1.448 | — |
| 7 | 40 | 0.75 | 0.246 | 83% |
| E | 80 | 0.25 | 3.253 | — |
| 8 | 80 | 0.25 | 0.298 | 91% |
| F | 80 | 0.75 | 13.517 | — |
| 9 | 80 | 0.75 | 5.823 | 57% |

[1]: total sliding distance = 250 m
[2]: total wear = ball wear + disk wear

The results are graphically shown in FIGS. 4A, 4B, 4C, and 4D. The lactam-containing lubricating compositions were very versatile and provided significant wear reduction in various environments of load and speed.

Examples 10, 11 And G:

Additional wear tests in a ceramic-on-ceramic ball and disk system were performed in the same manner as Example 2 except that a 1 wt. % laurolactam in hexadecane lubricating composition was also examined in addition to caprolactam. The laurolactam was obtained from Aldrich Chemical, Milwaukee Wis. (Cat. No. A9,465-4, 98% pure, MW 197.32, m.p. 150°–153° C.). The caprolactam and laurolactam each were partly dissolved and partly dispersed at the 1.0 wt. % concentrations. The results are summarized in Table 4 and are graphically shown in FIG. 5.

TABLE 4

| Example | Additive in carrier fluid, wt. % | Wear ($mm^3$) ball | disk | total[2] | % reduction in wear |
|---|---|---|---|---|---|
| G | none[1] | 0.2083 | 1.0453 | 1.2536 | — |
| 10 | 1.0 wt % caprolactam | 0.0660 | 0.1355 | 0.2014 | 84% |
| 11 | 1.0 wt. % laurolactam | 0.0611 | 0.1054 | 0.1665 | 87% |

[1]: average of 16 test runs
[2]: Total wear = ball wear + disk wear @ 0.25 m/s sliding velocity, 250 m total sliding distance and 40 N load.

Figure 5:
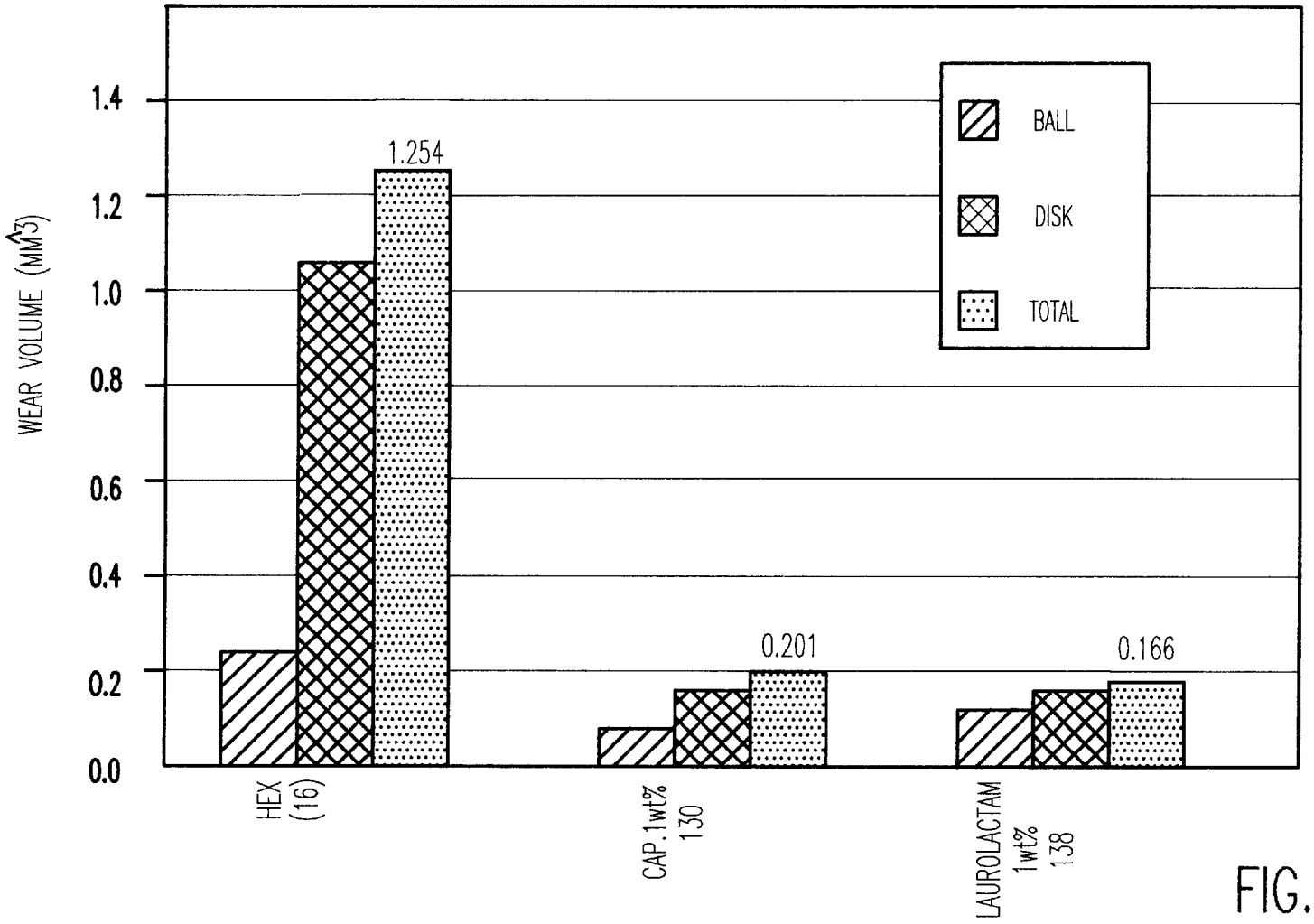
FIG. 5 is a graph showing wear reduction achieved with caprolactam at different concentration levels, and laurolactam, as antiwear agents for an alumina-on-alumina rubbing system.

The results summarized in Table 4 and graphically shown in FIG. 5 show that the lubricating compositions containing caprolactam and laurolactam exhibit outstanding wear reduction.

Examples 12 And H:

The effectiveness of the lubricating compositions containing lactams was examined in a steel-on-steel ball and disk system.

The AISI 52100 steel balls (Grade 10) were used in sliding contact with the polished 1045 steel disks, where the balls and disks had the dimensions set forth in the Experimental Procedure.

Tests were otherwise performed in the same manner as Example 1 using 1.0 wt. % ϵ-caprolactam in hexadecane as the lubricating composition as compared against a second test (control) using hexadecane alone (0% caprolactam). Wear was measured for the steel disks and balls according to the Experimental Procedure. The results are summarized in Table 5 below.

TABLE 5

| Example | Additive in carrier fluid, wt. % | Wear ($mm^3$) ball | disk | total[2] | % reduction in wear |
|---|---|---|---|---|---|
| H | none[1] | 0.0143 | 0.8213 | 0.8356 | — |
| 12 | 1.0 wt % caprolactam | 0.0003 | 0.0537 | 0.0540 | 94% |

[1]: average of 16 test runs
[2]: Total wear = ball wear + disk wear @ 0.25 m/s sliding velocity, 250 m total sliding distance and 40 N load.

Figure 6:
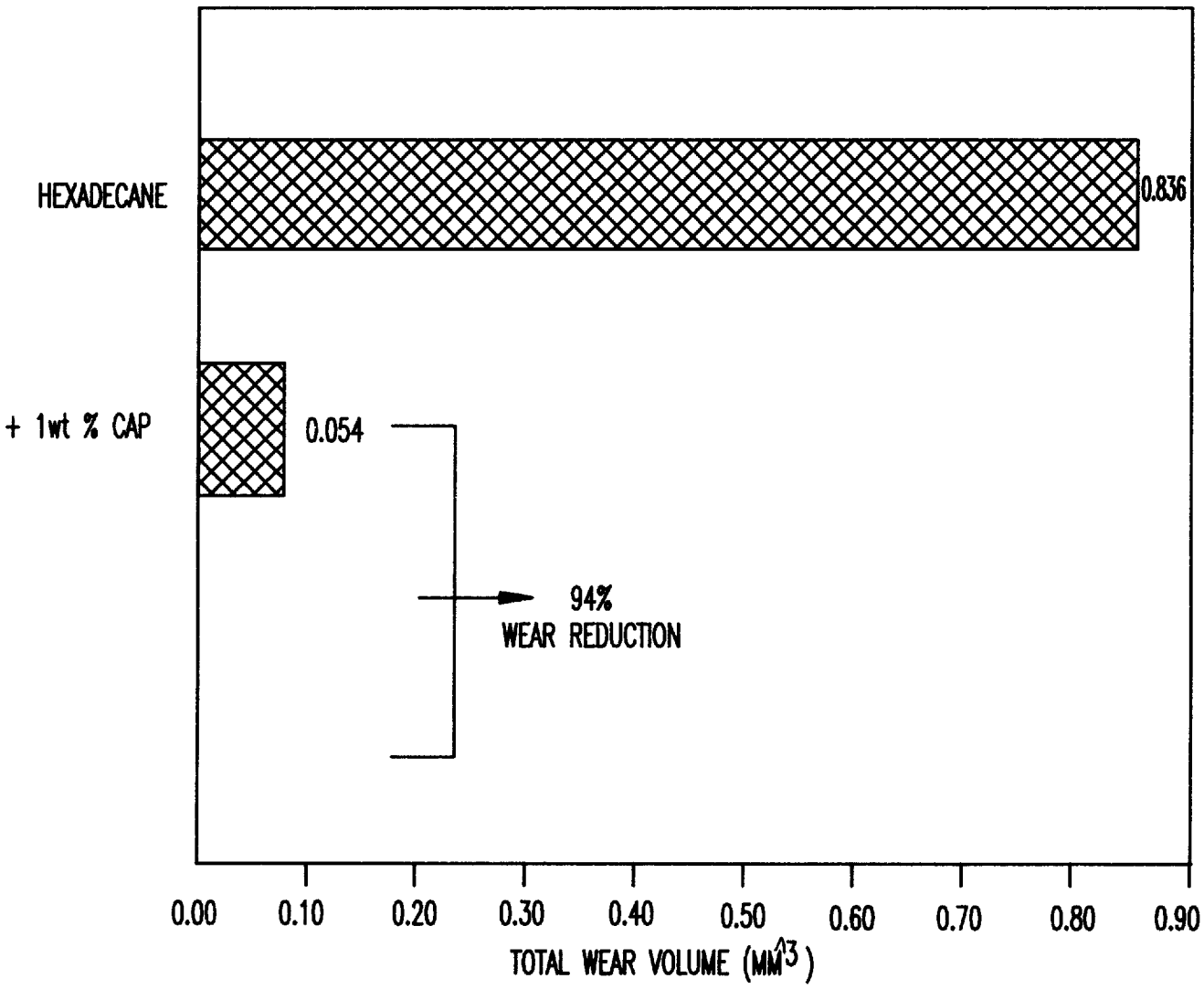
FIG. 6 is a graph showing wear reduction achieved with caprolactam as an antiwear agent for a steel-on-steel rubbing system.

FIG. 6 graphically shows the results which indicate a remarkable 94% reduction in wear of the steel ball and disk were achieved with caprolactam as an antiwear agent for the steel-on-steel rubbing system.

These data show the effectiveness at low concentrations and versatility of the anti-wear, lubricating compositions of the invention for reducing wear in different types of rubbing substrate materials.

While the invention has been described in terms of its preferred embodiments, those skilled in the art will recognize that the invention can be practiced with modification within the spirit and scope of the appended claims.

What is claimed:

1. A method reducing wear between rubbing surfaces, comprising the steps of:

providing a first solid material having first surface in rubbing contact with a second surface of a second solid material;

contacting said first surface with a cyclic amide in an amount effective to reduce wear of said rubbing surfaces, wherein said cyclic amide has the formula:

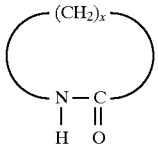

where x is a positive integer ranging from 5 to 11, wherein said first solid material and second solid material are each independently selected from the group consisting of metals, ceramics, fiber-reinforced polymeric composites, plastics, and wood.

2. The method of claim 1, wherein said contacting of said first surface with said cyclic amide is provided at a time before, during, or before and during said rubbing contact.

3. The method of claim 1, wherein said cyclic amide is caprolactam.

4. The method of claim 1, wherein said cyclic amide is laurolactam.

5. The method of claim 1, wherein said cyclic amide is 2-azacyclooctanone.

6. The method of claim 1, wherein said cyclic amide is 2-azacyclononanone.

7. A method for reducing wear in rubbing parts comprising the steps of:

providing a first solid material having a first surface which will be exposed to rubbing contact with a second surface of a second solid material;

contacting at least said first surface of said first solid material with a lubricating composition comprising a carrier medium and cyclic amide, wherein said carrier medium is selected from the group consisting of a liquid, a gas, and a semi-solid, and wherein said cyclic amide has the formula:

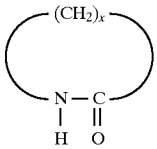

where x is a positive integer ranging from 5 to 11;

providing said rubbing contact between said first solid material and said second solid material, whereby said lubricating composition reduces wear and friction of at least one of said first solid material at said first surface or said second solid material at said second surface exposed to said rubbing contact, wherein said first solid material and second solid material are each independently selected from the group consisting of metals, ceramics, fiber-reinforced polymeric composites, plastics, and wood.

8. The method of claim 7, wherein said cyclic amide is dispersed or dissolved in said carrier medium.

9. The method of claim 7, wherein said carrier medium is selected from the group consisting of hydrocarbon oils, mineral oils, synthetic oils, gasoline, kerosene, jet fuel, polyethylene glycols, water, and aqueous polyethylene glycol solutions.

10. The method of claim 9, wherein said cyclic amide is contained in said liquid in an amount of 0.01 to 10.0%, by weight.

11. The method of claim 7, wherein said carrier medium is selected from the group consisting of air, nitrogen, gaseous combustion fuels, and gaseous combustion products.

12. The method of claim 7, wherein said carrier medium is a semi-solid carrier, said cyclic amide being dispersed in said semi-solid carrier.

13. The method of claim 12, wherein said semi-solid carrier is selected from the group consisting hydrocarbon grease, silicone grease, and wax.

* * * * *